US008881410B2

(12) United States Patent
Luettgens

(10) Patent No.: US 8,881,410 B2
(45) Date of Patent: Nov. 11, 2014

(54) SHARPENER, ESPECIALLY FOR A COSMETIC OR PHARMACEUTICAL PENCIL

(75) Inventor: Fritz Luettgens, Erlangen (DE)

(73) Assignee: KUM Limited, Trim, Co. Meath (IE)

( * ) Notice: Subject to any disclaimer, the term of this patent is extended or adjusted under 35 U.S.C. 154(b) by 434 days.

(21) Appl. No.: 13/188,547

(22) Filed: Jul. 22, 2011

(65) Prior Publication Data

US 2012/0017451 A1 Jan. 26, 2012

(30) Foreign Application Priority Data

Jul. 22, 2010 (DE) ..... 10 2010 031 915

(51) Int. Cl.
*B43L 23/08* (2006.01)
*A45D 40/20* (2006.01)

(52) U.S. Cl.
CPC ..... *B43L 23/08* (2013.01); *A45D 40/20* (2013.01); *A45D 2040/202* (2013.01)
USPC ..... 30/457; 30/451; 144/28.11

(58) Field of Classification Search
CPC ..... B43L 23/00; B43L 23/08; B43L 23/004; B43L 23/06; B43L 23/085
USPC ..... 30/451, 452, 454–457, 460, 462; 144/28.1, 28.11
See application file for complete search history.

(56) References Cited

U.S. PATENT DOCUMENTS

| | | | | |
|---|---|---|---|---|
| 552,020 | A | 12/1895 | Veazie | |
| 2,702,022 | A | 2/1955 | Fors | |
| 5,894,669 | A * | 4/1999 | Luttgens | 30/452 |
| 6,732,437 | B2 * | 5/2004 | Eisen et al. | 30/461 |
| 2004/0261275 | A1 * | 12/2004 | Fregeolle et al. | 30/457 |

FOREIGN PATENT DOCUMENTS

| | | | |
|---|---|---|---|
| DE | 3824883 | A1 | 2/1990 |
| JP | H2144499 | U | 12/1990 |

OTHER PUBLICATIONS

A copy of the defintion of the word "rasp".*

* cited by examiner

*Primary Examiner* — Phong Nguyen
(74) *Attorney, Agent, or Firm* — Laurence A. Greenberg; Werner H. Stemer; Ralph E. Locher

(57) ABSTRACT

A sharpener for sharpening a pencil, in particular a cosmetic pencil, is especially suitable, when used correctly, for producing a particularly uniform outer jacket edge in the region of the pencil tip. The sharpener includes a sharpener body, in which a pencil guide channel is provided. The pencil guide channel has a circular cone-shaped channel section and opens out in a pencil inlet opening on the outer side of the sharpener body. A paring blade is positioned tangentially to the lateral surface of the channel section. The paring blade serves to pare off a pencil tip, which includes a front lead section and a rear outer jacket section. A shaping tool cuts a shoulder into the pencil tip, the shoulder being set back in relation to a circular cone-shaped enveloping surface of the pencil tip. The shaping tool is arranged relative to the pencil guide channel to insert the shoulder into the transition between the lead section and the outer jacket section of the pencil tip.

13 Claims, 5 Drawing Sheets

SHARPENER, ESPECIALLY FOR A COSMETIC OR PHARMACEUTICAL PENCIL

BACKGROUND OF THE INVENTION

Field of the Invention

The invention relates to a sharpener for a pencil, in particular for a cosmetic or pharmaceutical pencil.

A sharpener is usually used to sharpen the lead of a pencil and at the same time to pare off a lead casing—also referred to below as a (pencil) outer jacket—, if present, in the region of the pencil tip. Conventionally, a sharpener includes an approximately cuboid or wedge-shaped sharpener body, in which a pencil guide channel with a substantially circular cone-shaped tip cone is provided as guide for the pencil tip in such a manner that the lateral surface thereof is approximately tangent to an outer surface of the sharpener body. In the surrounding region of said tangent, the tip cone is open towards the adjacent outer surface of the sharpener body via a shaving eject slot. A sharpener also includes a paring blade, which is attached to the sharpener body in a tangential manner with regard to the lateral surface of the tip cone and projects in such a manner into the shaving eject slot by way of a cutting edge that, when a pencil inserted into the tip cone is rotated in relation to the sharpener body, a shaving is removed from the pencil by the cutting edge of the paring blade.

Even when high quality pencils and sharpeners are used, in the region in which the lead protrudes from the outer jacket at the sharpened pencil tip, no uniform—in particular smooth or rectilinear—transition is obtained between the outer jacket material and the lead material. Rather, in the case of a sharpened pencil, this transition is often frayed or raveled out in an oblique and more or less jagged manner. On the one hand, this is because the pencil is always guided in the pencil guide channel with a certain play, and consequently, when being sharpened, is not inserted, as a rule, in a precisely centered and axially parallel manner in the pencil guide channel. On the other hand, the lead is not centered precisely either, as a rule, but is embedded in the outer jacket material with a certain eccentric tolerance. This effect is strengthened even more in that the outer jacket material tends to split in the region of the transition as a result of its material strength, which in this case is round about zero.

The transition between lead material and outer jacket material in the region of the pencil tip is referred to below in short as the "outer jacket edge".

The non-uniform outer jacket edge in the case of pencils and crayons, above all, spoils the aesthetic effect. In the case of a cosmetic or pharmaceutical pencil, the non-uniform outer jacket edge also causes problems over and above this as regards skin tolerance. If, namely, such a pencil is not regularly resharpened, the jagged outer jacket edge, when used progressively, comes into the direct vicinity of the skin part to which the core material is applied and can cause skin irritations or skin injuries and consequently resultant pain or even infection there. This causes problems particularly when looked at from the additional consideration that cosmetic and pharmaceutical pencils are often used on particularly sensitive skin parts, for example eye lids or lips.

BRIEF SUMMARY OF THE INVENTION

The object underlying the invention is to provide a pencil sharpener which is especially suitable for producing a particularly uniform outer jacket edge in the region of the pencil tip of the sharpened pencil when used in the correct manner.

This object is achieved according to the invention Accordingly, the sharpener, provided for sharpening a pencil, which includes a lead and a pencil outer jacket which envelopes said lead, includes a sharpener body, in which a pencil guide channel is provided. The pencil guide channel includes at least one circular cone-shaped channel section with a base diameter that is in excess of the diameter of the pencil to be sharpened. Said circular cone-shaped channel section is also referred to below as a "tip cone". The pencil guide channel opens out in a pencil inlet opening on the outer side of the sharpener body.

In addition, the sharpener includes a paring blade which is positioned in an approximately tangential manner in relation to the lateral surface of the tip cone. The paring blade serves for paring off a pencil tip which, in the case of a pencil of the abovementioned type, necessarily includes a front lead section and a rear outer jacket section. The term "lead section" in this regard refers to that section of the pencil tip in which the lead protrudes towards the outside. The term "outer jacket section" is correspondingly that section of the pencil tip in which the pencil outer jacket protrudes towards the outside.

In this case, as claimed in the invention, the sharpener includes a shaping tool for inserting a shoulder into the pencil tip, said shoulder being set back opposite a circular cone-shaped enveloping surface of the pencil tip, as is produced by the paring blade, and therefore forming a contour that is concave in relation to the circular cone-shaped enveloping surface. In this case, the shaping tool is arranged in such a manner with regard to the pencil guide channel that it inserts the shoulder into the transition between the lead section and the outer jacket section of the pencil tip.

The shaping tool, therefore, inserts the shoulder precisely into the region of the pencil tip, in which the non-uniform outer jacket edge is situated in the case of a pencil tip formed by means of a traditional pencil sharpener. Said edge of the outer jacket material is made uniform by the shaping tool provided as claimed in the invention, i.e. is smoothed and brought into a rotationally symmetrical form. On the one hand, this improves the appearance of the pencil sharpened in such a fashion. The sharpener as claimed in the invention can also be used in an advantageous manner to sharpen crayons and pencils. On the other hand, in the case of cosmetic and pharmaceutical pencils, the risk of injury to the skin or skin irritation, if the non-resharpened pencil continues to be used, is additionally as good as ruled out by the smoothed outer jacket edge.

The shaping tool is preferably designed to form a step-shaped contour as a shoulder into the pencil tip with a wall region that is close to the tip and a wall region that is remote from the tip and is offset in a sharp-edged manner from the wall region close to the tip, the wall region that is close to the tip extending approximately cylindrically, and consequently approximately parallel to the pencil axis. The wall region remote from the tip, in contrast, is preferably created in such a manner that it is oriented at least predominantly approximately radially to the pencil axis. The term "sharp-edged" in this case refers to a transition, the radius of which is small in comparison to the width of the adjoining wall regions of the shoulder. In an expedient manner, the wall region that is close to the tip extends towards the apex of the pencil tip as far as the outer circumference of the pencil tip. In this case, consequently, it merges preferably continuously (with no new step) into the circular cone-shaped wall region of the pencil tip.

The shoulder is preferably inserted into the pencil tip by the shaping tool in such a manner that the pencil surface in the wall region close to the tip is formed exclusively by the lead. The shaping tool, in other words, is formed and arranged in the pencil guide channel in such a manner that, in the entire wall region close to the tip, it removes material extending as far as the lead, and where applicable right into said lead. In contrast, the wall region of the shoulder remote from the tip is preferably inserted into the pencil tip in such a manner by the shaping tool—to be correspondingly formed and arranged in the pencil guide channel—that said wall region is formed at least predominantly by the outer jacket. In other words, the step-shaped shoulder is preferably inserted into the pencil tip by the shaping tool in such a manner that the separation line between lead material and outer jacket material, that is to say the outer jacket edge, extends substantially along the transition between the two wall regions of the shoulder.

In a preferred embodiment of the sharpener, the shaping tool includes a working edge for removing outer jacket material and, as an option, also lead material. The working edge, in this case, is preferably oriented substantially radially at least in an inner section, i.e. perpendicularly to the axis of the pencil guide channel. This means that the influence of a bearing arrangement of the pencil lead, eccentric with reference to the axis of the pencil guide channel, on the shape of the outer jacket edge is minimized. This influence is completely prevented when the working edge is oriented precisely perpendicularly to the axis of the pencil guide channel at least in an inner section. However, it has been shown that, even with a shaping tool which has a working edge positioned slightly in relation to the radial direction, a sufficiently smooth outer jacket edge can be achieved. The term "substantially radially" consequently also refers to a working edge, the orientation of which deviates slightly from the radial direction, in particular forming a clearance angle (remote from the tip) with the axis of the pencil guide channel exceeding 80°, preferably >85°. In this case, the wall region of the shoulder remote from the tip formed by the shaping tool also has a slight conical form.

However, deviating from this, it is also conceivable for the working edge of the shaping tool to be positioned slightly against the insertion direction of the pencil at least in an inner region, such that the clearance angle (remote from the tip) formed between the working edge and the axis of the pencil guide channel is slightly in excess of 90°. In this case, the shaping tool forms a shoulder into the pencil tip where the outer jacket edge lies in a groove which is set back in the direction of the pencil end.

In a preferred embodiment of the sharpener, the shaping tool is designed as a type of blade, turning tool or moving iron. In this case, the working edge forms a main cutting edge for paring off the outer jacket or lead material. In an expedient further development, the shaping tool, on an inner edge, has a minor cutting edge substantially parallel to the axis of the pencil guide channel in addition to the working edge forming the main cutting edge. In this case, however, the minor cutting edge is preferably not oriented precisely parallel to the axis of the pencil guide channel, but encloses a (small) free angle with the axis of the pencil guide channel, for example of between 2° and 5°.

In an alternative embodiment, the shaping tool is designed as a type of file. In this case, the working edge is formed by a rasp.

With preferred dimensioning, the working edge—when viewed from the apex of the pencil tip—is arranged at an axial height that corresponds to approximately one third of the overall length of the tip cone. In this case, the distance formed between the working edge and the base of the tip cone is approximately twice as large as that formed between the working edge and the apex of the tip cone.

The working edge preferably has a concave development, in particular either in the form of an arc or a traverse. In the first case, the shaping tool cuts a shoulder, the wall section of which, remote from the tip, is convexly curved. In the latter case, the shaping tool cuts a shoulder with wall sections that extend straight in cross section and are at an angle to each other, in particular a radial wall section with a bezel on the outside.

In an embodiment which is particularly favorable as regards production engineering, the shaping tool is arranged on the side of the pencil guide channel lying opposite the paring blade in the radial direction.

In an alternative design, the shaping tool is arranged on the side of the pencil guide channel facing the paring blade in the radial direction. The shaping tool, in this case, can be formed either by a part which is separate from the paring blade and is preferably arranged under the paring blade, or is integrally formed on the paring blade, in particular in one piece. The shaping tool, in this case, can be formed in particular by an outward bend of the paring blade. In addition, in place of one single paring blade, two paring blades offset to each other can be provided, of which one cuts out the outer jacket section, and the other the lead section of the pencil tip. The shaping tool, in this case, is formed on one of the ends of the two paring blades facing each other.

The shaping tool is preferably produced from high-grade steel.

In addition to the paring blade and the shaping tool, in a preferred embodiment the sharpener also includes a forming blade, in particular made of steel or plastics material, for rounding off the apex of the pencil tip. In this embodiment, the sharpener is suitable in particular for the sharpening of cosmetic and pharmaceutical pencils. In an expedient design, the forming blade is a part which is separate from both the paring blade and the shaping tool. Deviating from this, however, it can also be designed integrally with the paring blade and/or the shaping tool.

Exemplary embodiments of the invention are explained below by way of a drawing, in which, in detail:

DESCRIPTION OF THE INVENTION

Parts and sizes that correspond to each other are always provided with identical references in all the figures.

Figure 1:
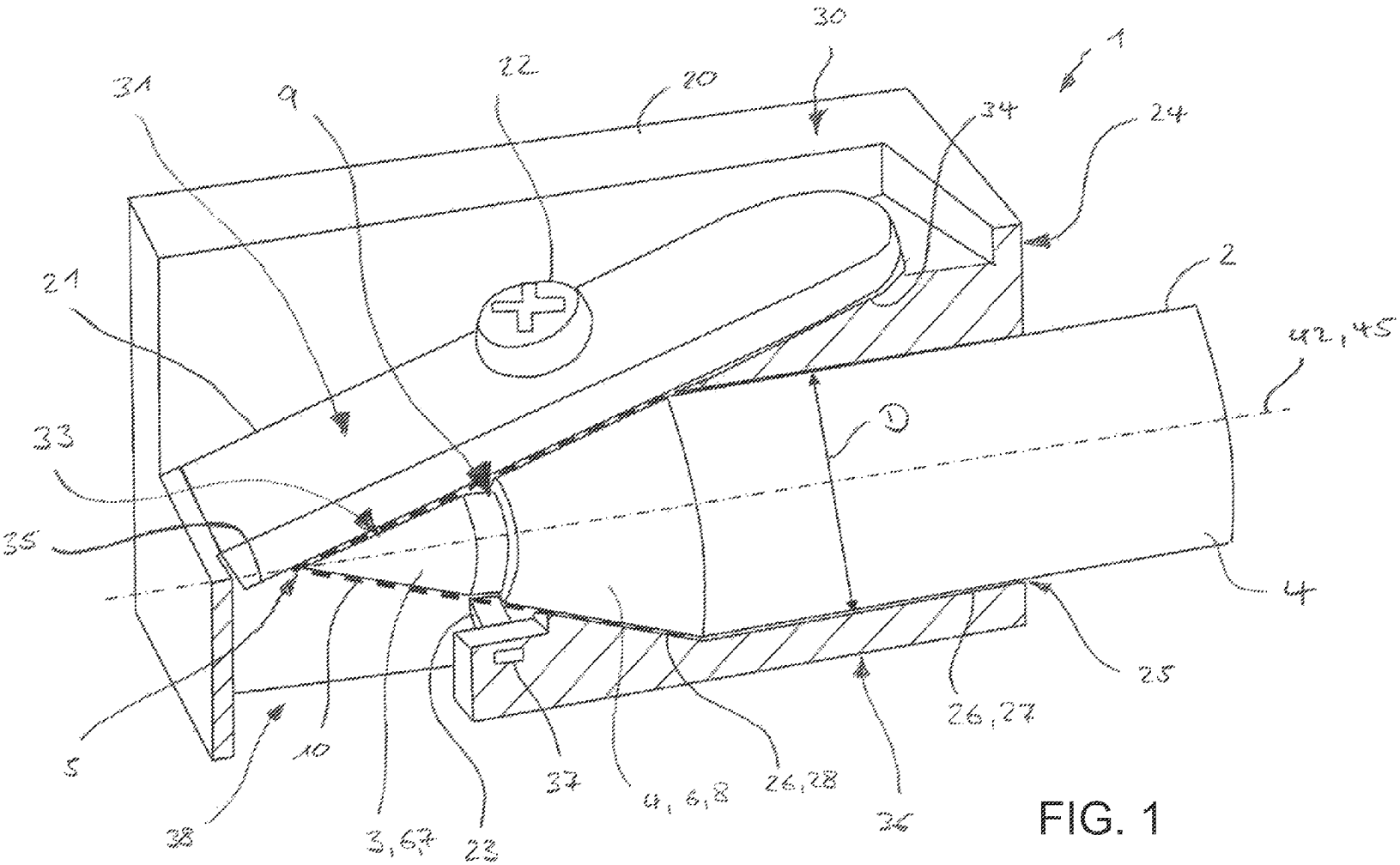
FIG. 1 shows a perspective sectional representation of a first embodiment of a sharpener with a sharpener body, a paring blade for paring off a conical pencil tip and a shaping tool for inserting a shoulder in the pencil tip.

FIG. 1 shows a sectional representation of a first embodiment of a sharpener 1, into which a pencil 2 (not shown in section) is introduced in the correct manner for sharpening. The pencil 2 is, in particular, a cosmetic pencil.

The pencil 2 includes a lead 3, which is enveloped by a substantially cylindrical pencil outer jacket 4 made of wood. At one end 5, the pencil 2 has already been sharpened to form a substantially circular cone-shaped pencil tip 6. The pencil tip 6 is subdivided substantially into a front lead section 7 and a rear outer jacket section 8. At the transition, already also designated the outer jacket edge, between lead section 7 and outer jacket section 8, that is to say at the exit point of the lead 3 from the pencil outer jacket 4, a shoulder 9 is inserted in the pencil tip 6. The shoulder 9 is set back in the radially inward direction in relation to a circular cone-shaped enveloping surface 10 of the pencil tip 6, indicated by the dotted line.

The sharpener 1 includes a sharpener body 20, a paring blade 21, which is fastened to the sharpener body 20 by means of a screw 22, and a shaping tool 23 for inserting the shoulder 9.

The sharpener body 20, which is produced from plastics material in this case as an example, has on a front side 24 (on the right-hand side in the representation) a round pencil inlet opening 25. Connected thereto in the interior of the sharpener body 20 is a bore which forms a pencil guide channel 26 connected to the pencil inlet opening 25. The pencil guide channel 26 includes a first cylindrical channel section 27 that faces the pencil inlet opening 25 and a second circular cone-shaped channel section that adjoins thereto. Said circular cone-shaped channel section is referred to below as tip cone 28. The tip cone 28 has a basic diameter D which slightly exceeds the diameter of the pencil 2.

On an upper side 30 adjoining the front side 24, the sharpener body 20 has an inclined face 31 oriented approximately tangentially to the tip cone 28. Along the contact line between the inclined face 31 and the tip cone 28, the lateral surface of the tip cone 28 is open to the outer side of the sharpener body 20 through a continuous longish opening. Said opening serves for the ejection of pared shavings from the pencil outer jacket 4 and from the lead 3 and is referred to below as shaving eject slot 33.

Provided additionally on the inclined surface 31 is a blade receptacle 34 offset in a step-shaped manner, in which the paring blade 21 is inserted. In this case, a cutting edge 35 of the paring blade 21, formed along its longitudinal edge, protrudes so far into the shaving eject slot 33 that, when the pencil 2 is rotated in the pencil guide channel 26, it pares off a part of the outer jacket and lead material to form the pencil tip 6.

In the region of a bottom side 36 opposite the upper side 30, a tool receptacle 37 is inserted into the sharpener body 20, the shaping tool 23 being fastened in said tool receptacle. The shaping tool 23, in this case, is pressed into the tool receptacle 37 once the sharpening body 20 has been produced. As an alternative to this, the shaping tool 23 is injection molded with the material of the sharpener body 20 during production of the sharpener body 20.

The shaping tool 23, in this case, is designed as a narrow paring blade, for instance in the manner of a turning tool (or: moving iron). The shaping tool 23 projects further into the tip cone 28 in the radial direction than the cutting edge 35 of the paring blade 21. When the pencil 2 is rotated, the shoulder 9 is consequently inserted into the pencil tip 6 with the aid of the shaping tool 23.

When viewed in the longitudinal direction of the pencil guide channel 26, the shaping tool 23 is arranged at the transition between lead section 7 and outer jacket section 8 such that the shoulder 9 is inserted into the pencil tip 6 in precisely this region.

In the front region of the tip cone 28, the sharpener body 20 is designed to be open towards the bottom side 36 such that this region forms a wider shaving eject opening 38 serving as exit opening for the shavings pared off by means of the shaping tool 23.

Figure 2:
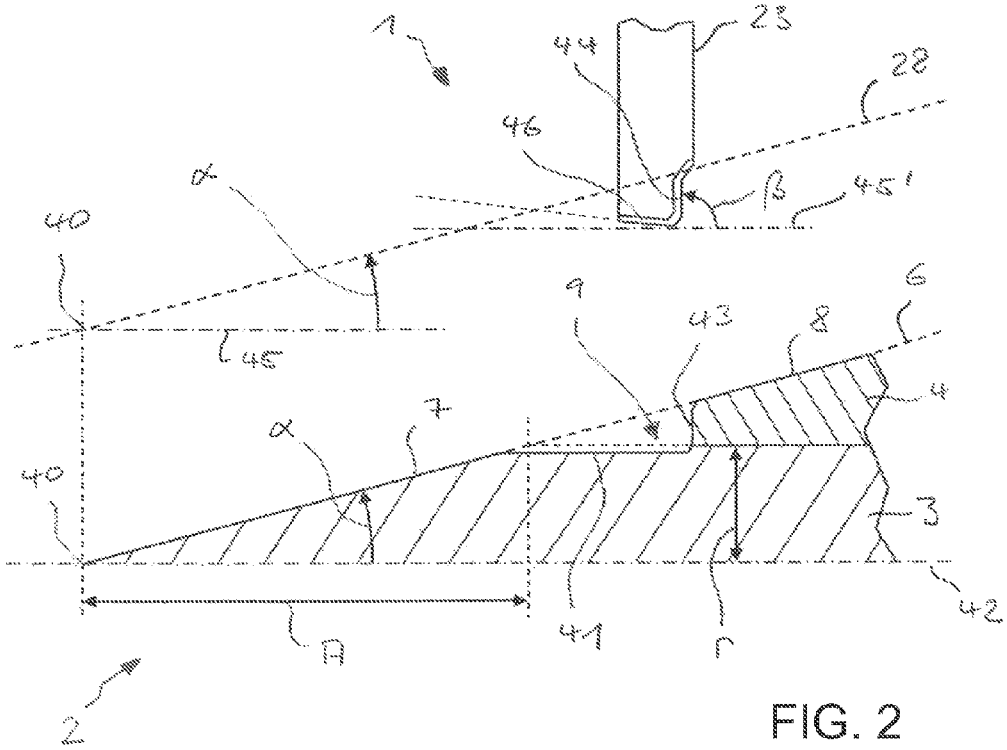
FIG. 2 shows a schematic representation of the shaping tool of the sharpener in FIG. 1, together with the pencil shown in longitudinal section.

In FIG. 2 the shaping tool 23 and a part of the pencil tip 6 or the tip cone 28 are shown again in an enlarged manner, the shaping tool 23 and the tip cone 28 being shown offset in relation to the pencil 6 for reasons of clarity. It can be seen from this representation that the outer jacket edge, at a given lead radius r and a given half cone opening angle $\alpha$, is at a distance A from the apex 40, i.e. the common cone tip of the tip cone 28 and the pencil tip 6, the equation $$A = \frac{r}{\tan(\alpha)}$$

applying to said distance A. So that the shaping tool 23 removes at least predominantly outer jacket material, the shaping tool 23 is arranged at a distance from the apex 40 slightly exceeding the distance A.

FIG. 2 also shows clearly that the shoulder 9 cut by the shaping tool 23 has a step-shaped contour, a wall region 41, close to the tip, of this contour extending approximately parallel to the axis 42 of the pencil 2, whilst a wall region 43, remote from the tip and adjacent thereto, extends predominantly radially to the axis 42, but is beveled on the outer side. In the radial direction, the shoulder 9 protrudes sufficiently towards the axis 42 that, in the wall region 41 close to the tip, the shaping tool 23 removes the pencil surface as far as up to the lead material. The wall region 41, close to the tip, of the shoulder 9 formed in this manner is consequently formed by the lead material. In contrast, in the wall region 43 remote from the tip, the pencil surface is formed at least predominantly by the outer jacket material.

For paring off the shoulder 9, the shaping tool 23 has a working edge, which is designed in the form of a main cutting edge 44 and faces the inlet opening 25 of the pencil guide channel 26. The main cutting edge 44 encloses a clearance angle $\beta$ of 90°±2° with the axis 45 of the pencil guide channel 26—as indicated in FIG. 2 by way of an axially parallel line 45'. Therefore, the main cutting edge 44 is consequently oriented substantially radially to the axis 45.

In addition, the shaping tool 23 has on its inner edge a minor cutting edge 46, which is arranged approximately at right angles to the main cutting edge 44 and serves to cut off a shaving removed laterally by the main cutting edge 44. The minor cutting edge 46 is not oriented precisely in an axially parallel manner, but is released slightly to the outside towards the apex 40 such that it does not scrape over the lead 3 over its entire length.

Figure 3:
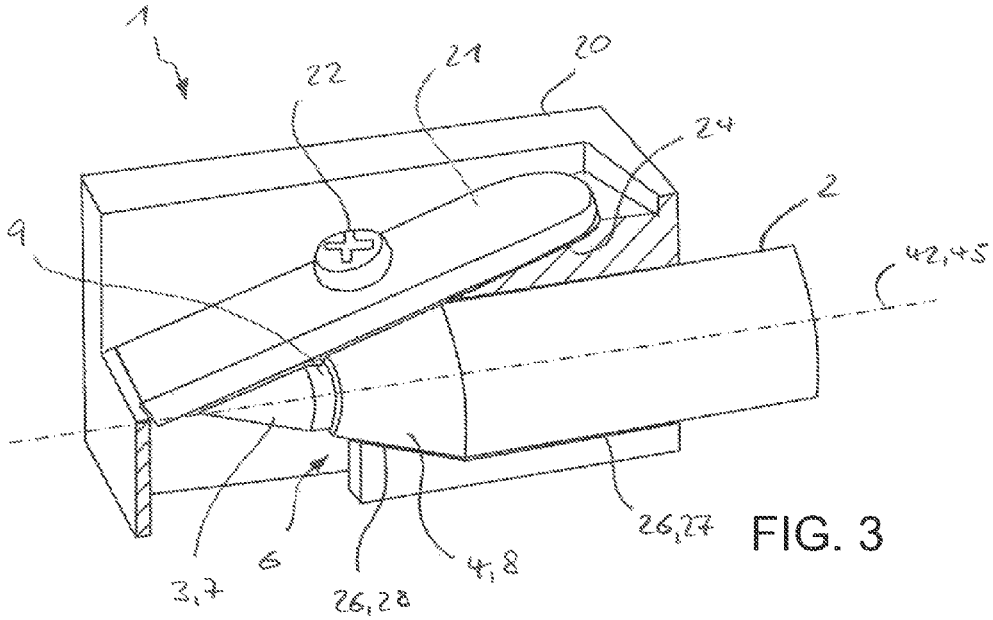
FIG. 3 shows a representation as in FIG. 1 of a second embodiment of the sharpener.
Figure 4:
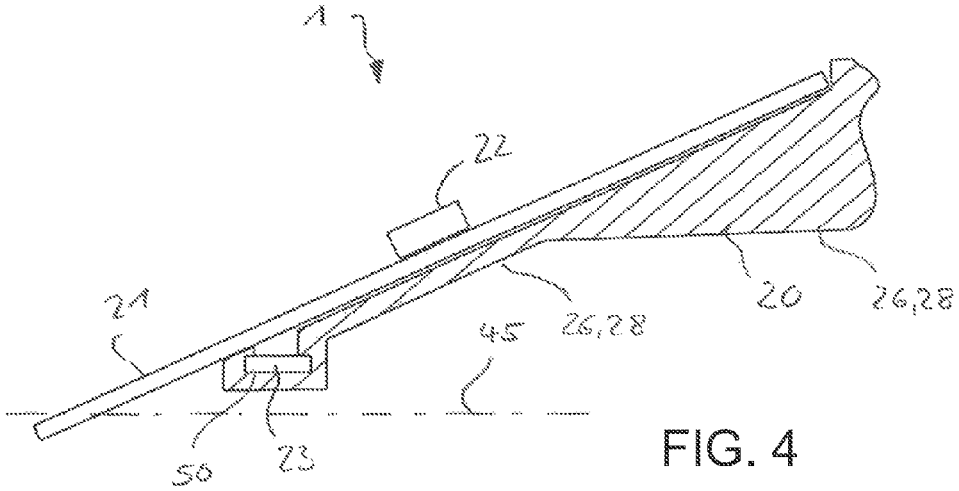
FIG. 4 shows a schematic representation of a longitudinal section, represented as a cutout, through the sharpener in FIG. 3.

FIGS. 3 and 4 show a second embodiment of the sharpener 1. This corresponds substantially to the first embodiment. In contrast to said first embodiment, however, in this case the shaping tool 23 is arranged in the radial direction on the same side as the paring blade 21. It can be seen in FIG. 4 that the shaping tool 23 is once again inserted in a tool receptacle 50 with accuracy of fit, substantially in an analogous manner to the first embodiment, in this case said tool receptacle being arranged, however, below the paring blade 21.

Figure 5:
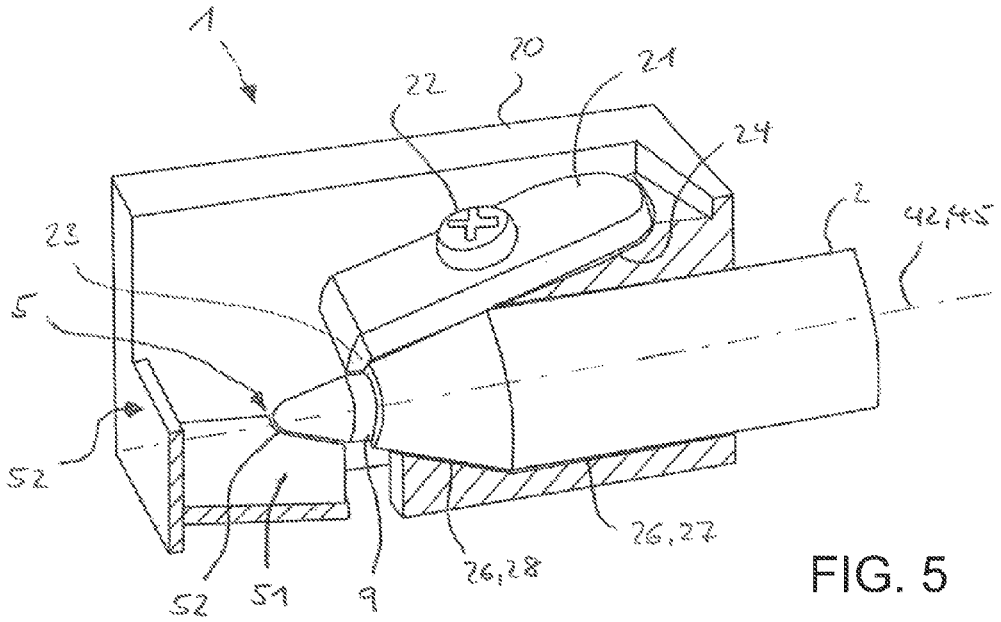
FIG. 5 shows a representation as in FIG. 1 of a third embodiment of the sharpener with a shortened paring blade which is designed integrally with the shaping tool, and an additional forming blade for rounding off the pencil tip.
Figure 6:
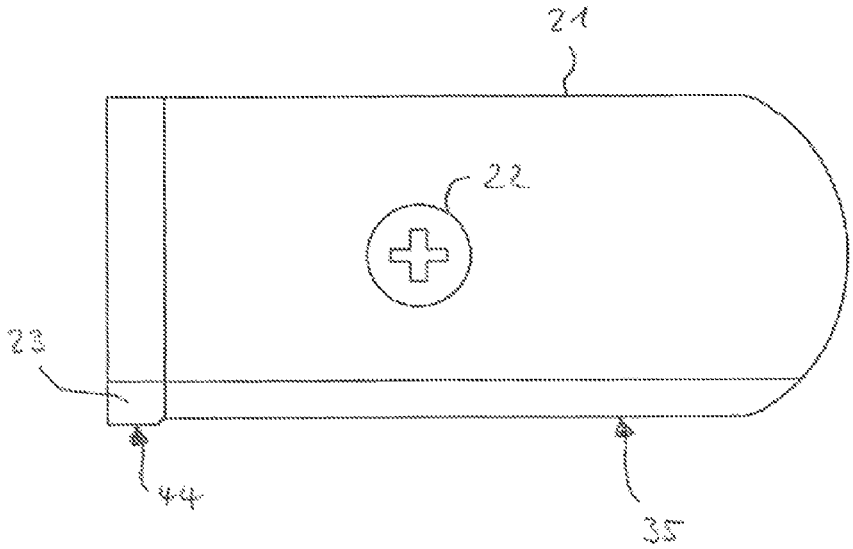
FIG. 6 shows a top view of the paring blade of the sharpener in FIG. 5.
Figure 7:
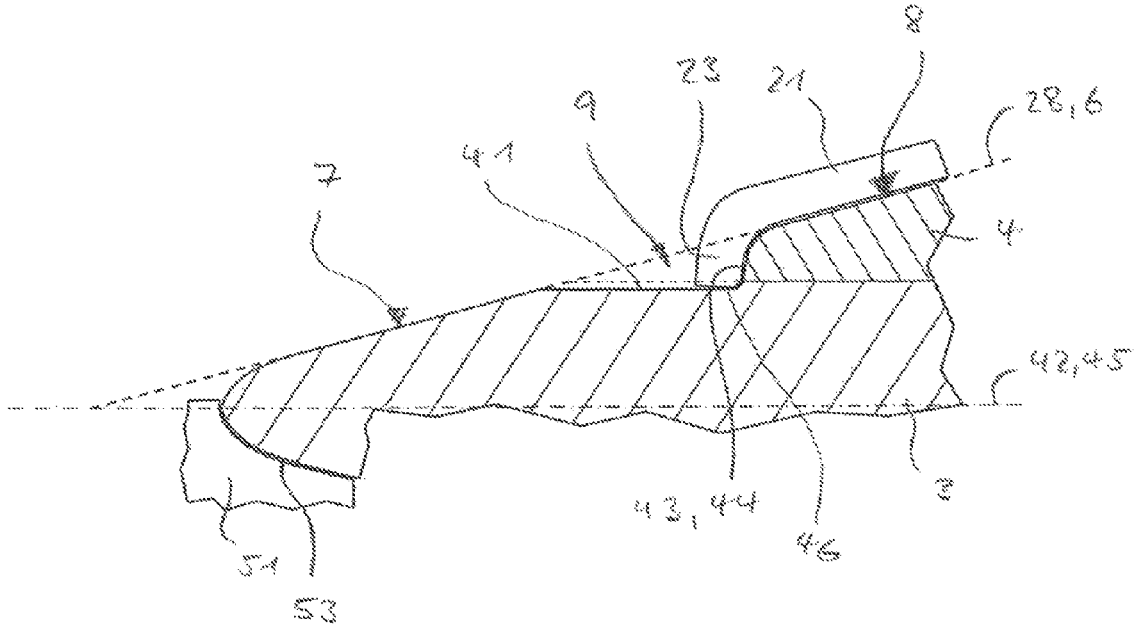
FIG. 7 shows a representation as in FIG. 2 of the shaping tool and the forming blade as in FIG. 5, as well as the pencil worked by the same.

FIGS. 5 to 7 show a third embodiment of the sharpener 1. The third embodiment corresponds substantially to the two first embodiments; however, in this case the paring blade 21 is shorter compared to these two first embodiments. When viewed in the longitudinal direction, it only stretches approximately as far as the shoulder 9 which is to be provided in a correct manner. In this embodiment, the shaping tool 23 is designed in one piece with the paring blade 21 by the end of the paring blade 21 near the tip being curved round in the direction of the axis 45. In addition in this case, in contrast to the two other embodiments, a forming blade 51 produced from plastics material is integrally molded on the sharpener body 20 in the interior of the sharpener body 20 on a rear side 52 situated opposite to the front side 24. The forming blade 51 has an arcuate cutting edge 53 which faces the tip cone 28 and projects in the direction of the pencil tip 6 in such a manner that, when the pencil 2 is rotated, its lead section 7 is rounded off at the front end 5 by the cutting edge 53.

FIG. 6 shows a top view of the paring blade 21. It can be seen from this that the shaping tool 23 protrudes slightly in the manner of a nose beyond the cutting edge 35 of the paring blade 21.

FIG. 7 shows the shaping tool 23 in FIGS. 5 and 6 once again in an enlarged manner. As is clear from this representation, in this embodiment the main cutting edge 44 of the shaping tool 23 is in the form of a concave arc, as a result of which the wall region 43, remote from the tip, of the shoulder cut by this shaping tool 23 also has a curvature—albeit a convex curvature. At its inner end, the main cutting edge 44 extends once again approximately radially with reference to the axis 45 such that the wall region 43 worked by said main cutting edge 44 also bears against the wall region 41, close to the tip, of the shoulder 9 in an approximately vertical manner.

Figure 8:
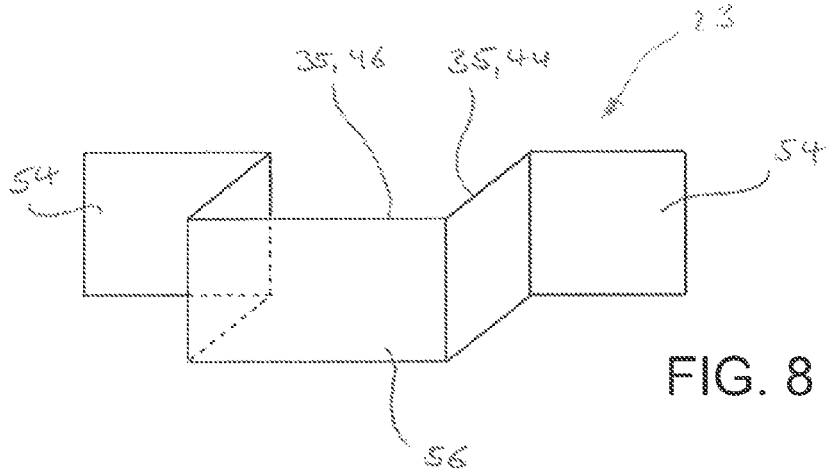
FIG. 8 shows a perspective view of the shaping tool in a fourth embodiment of the sharpener.
Figure 9:
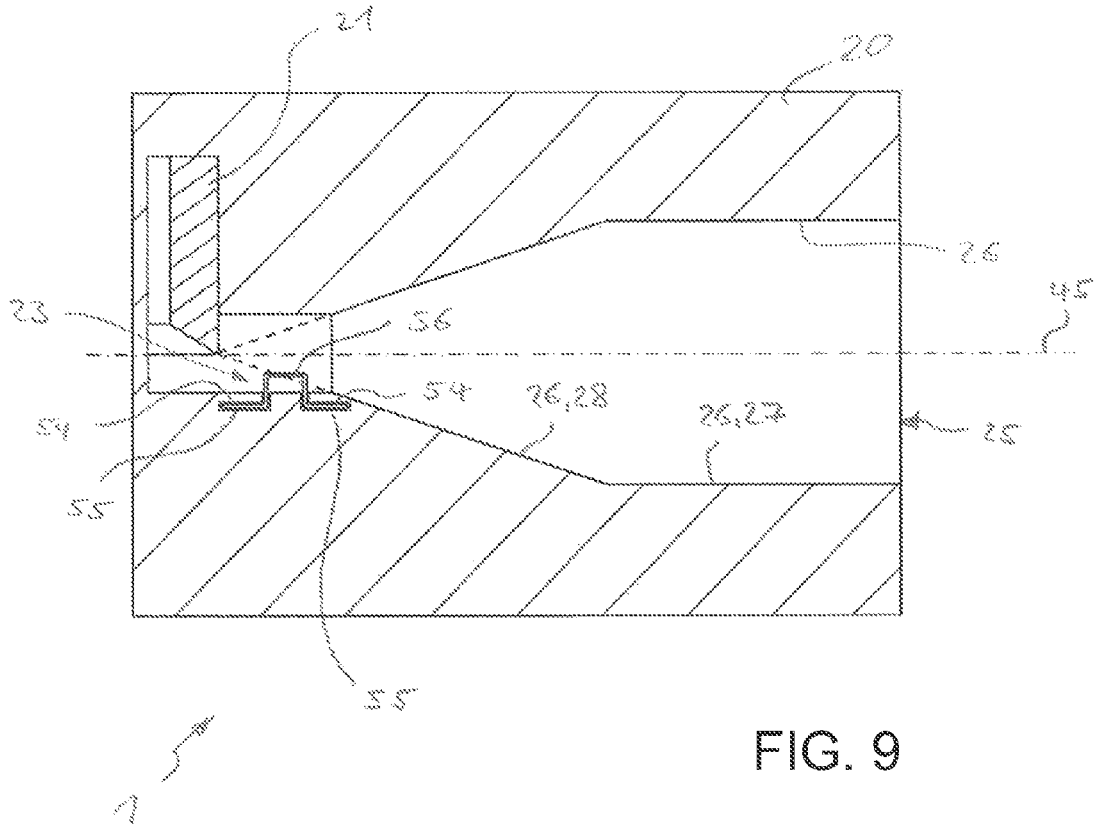
FIG. 9 shows a horizontal longitudinal section of the fourth embodiment of the sharpener with the shaping tool inserted.

In the case of the fourth embodiment of the sharpener 1 represented in FIGS. 8 and 9, the shaping tool 23 is not realized in the form of a one-piece metal part, but is formed from a curved sheet metal part, which, in a preferred design in particular, in a greatly simplified manner, has the form of a letter Ω—as can be seen in FIG. 8. In this design, the shaping tool 23 is held by way of both end portions 54 in an interlocking manner in complementarily formed slots 55 of the sharpener body 20 such that it protrudes by way of a central section 56, which is curved in an approximately U-shaped manner, into the tip cone 28.

The realization of the shaping tool 23 as a sheet metal part is advantageous, on the one hand, for reasons of simple and cost-effective producibility. On the other hand, this embodiment also promotes shaving removal as a result of the very narrow shaping tool 23.

In a further embodiment (not shown explicitly) of the sharpener as claimed in the invention, the shaping tool (produced in one piece or as a sheet metal part) can be inserted into and removed from the tip cone in a reversible manner, such that the shoulder-cutting action is able to be "switched on and off" at will. To this end, the shaping tool is preferably guided on the sharpener body so as to be tiltable, rotatable or displaceable, or, as an option, so as to be removable completely out of the sharpener body.

The individual features of the sharpener 1, described in each case in conjunction with the exemplary embodiments, can be combined with each other in an arbitrary manner within the framework of the invention.

The invention claimed is:

1. A sharpener for sharpening a pencil, the pencil having a lead and a pencil outer jacket enveloping the lead, the sharpener comprising:

a sharpener body formed with a pencil guide channel, said pencil guide channel including a circular cone-shaped channel section and opening out in a pencil inlet opening on an outer side of said sharpener body;

a paring blade positioned substantially tangentially relative to a jacket surface of said circular cone-shaped channel section for paring off a pencil tip, the pencil tip including a forward lead section and a rear outer jacket section; and a shaping tool configured for inserting a shoulder in the pencil tip, said shoulder being set back in relation to a circular cone-shaped enveloping surface of the pencil tip for defining a step, said shaping tool being disposed relative to said pencil guide channel so as to form the shoulder into a transition between the lead section and the outer jacket section of the pencil tip.

2. The sharpener according to claim 1, wherein said shaping tool includes a working edge for removing outer jacket material and, optionally, lead material, wherein said working edge extends substantially radially towards an axis of said pencil guide channel.

3. The sharpener according to claim 2, wherein said working edge forms a main cutting edge for paring off outer jacket material and, optionally, lead material.

4. The sharpener according to claim 3, wherein, on an inside edge, said shaping tool has a minor cutting edge extending substantially parallel to the axis of said pencil guide channel.

5. The sharpener according to claim 2, wherein said circular cone-shaped channel section has a given length, and said working edge, when viewed from an apex of said circular cone-shaped channel section, is disposed approximately at an axial height of a third of a length of said channel section.

6. The sharpener according to claim 2, wherein said working edge has a concave form.

7. The sharpener according to claim 1, wherein said shaping tool is in the form of a rasp.

8. The sharpener according to claim 1, wherein said shaping tool is disposed on a side of said pencil guide channel facing said paring blade in a radial direction.

9. The sharpener according to claim 8, wherein said shaping tool is integrally formed in one piece with said paring blade.

10. The sharpener according to claim 1, wherein said shaping tool is disposed on a side of said pencil guide channel remote from said paring blade in the radial direction.

11. The sharpener according to claim 1, which further comprises a forming blade disposed to round off a pencil tip.

12. The sharpener according to claim 11, wherein said forming blade is formed of steel or plastics material.

13. The sharpener according to claim 11 configured for sharpening a cosmetic pencil.

* * * * *

UNITED STATES PATENT AND TRADEMARK OFFICE

CERTIFICATE OF CORRECTION

PATENT NO. : 8,881,410 B2
APPLICATION NO. : 13/188547
DATED : November 11, 2014
INVENTOR(S) : Fritz Luettgens It is certified that error appears in the above-identified patent and that said Letters Patent is hereby corrected as shown below:

On the title page, item 73 Assignee: This should be omitted from the patent.

Signed and Sealed this
Twentieth Day of October, 2015

Michelle K. Lee

Michelle K. Lee
*Director of the United States Patent and Trademark Office*